US005391127A

United States Patent [19]

Nishimura

[11] Patent Number: 5,391,127

[45] Date of Patent: Feb. 21, 1995

[54] CONTROL APPARATUS IN A MOTOR VEHICLE FOR CONTROLLING A THROTTLE VALVE ON THE BASE OF ACTUATION OF AN ACCELERATOR PEDAL AND INTAKE AIR QUANTITY

[75] Inventor: Yukinobu Nishimura, Himeji, Japan

[73] Assignee: Mitsubishi Denki Kabushiki Kaisha, Tokyo, Japan

[21] Appl. No.: 60,962

[22] Filed: May 14, 1993

[30] Foreign Application Priority Data

May 15, 1992 [JP] Japan ..... 4-123356

[51] Int. Cl.[6] ..... F02D 9/00

[52] U.S. Cl. ..... 477/110; 477/97; 123/350

[58] Field of Search ..... 477/97, 107, 110, 906; 123/350, 399

[56] References Cited

U.S. PATENT DOCUMENTS

| | | | |
|---|---|---|---|
| 4,596,220 | 6/1986 | Oosuga et al. | 123/478 |
| 4,881,428 | 11/1989 | Ishikawa et al. | 477/110 X |
| 4,883,035 | 11/1989 | Shimomura et al. | 123/492 |
| 4,972,737 | 11/1990 | Makimoto | 477/110 |
| 5,025,380 | 6/1991 | Wataya et al. | 364/431 |
| 5,056,022 | 10/1991 | Witkowski et al. | 477/906 |
| 5,078,109 | 1/1992 | Yoshida et al. | 123/350 X |
| 5,117,711 | 6/1992 | Iizuka | 477/906 |
| 5,282,449 | 1/1994 | Takahashi et al. | 123/350 X |

FOREIGN PATENT DOCUMENTS

| | | | |
|---|---|---|---|
| 4009922 | 10/1991 | Germany | 123/350 |
| 262635 | 11/1986 | Japan . | |
| 63-277839 | 11/1988 | Japan | 123/350 |
| 1-83840 | 3/1989 | Japan | 123/350 |

*Primary Examiner*—Edward K. Look
*Assistant Examiner*—Michael S. Lee
*Attorney, Agent, or Firm*—Sughrue, Mion, Zinn, Macpeak & Seas

[57] ABSTRACT

A control apparatus with a fail-safe function not only serves to enhance acceleration performance of a motor vehicle but also prevents a runaway upon occurrence of a failure in a throttle control system. An accelerator pedal actuation detector detects a magnitude of depression of an accelerator pedal by the driver. A vehicle speed detector detects a running speed of the vehicle. A gear ratio detector detects a gear ratio or gear position of a transmission. A plurality of target throttle opening patterns representing relations between target values of throttle opening degree and depression magnitudes of the accelerator pedal are stored in a memory. A first controller selectively determines an optimum target throttle opening pattern on the basis of the vehicle speed and the gear ratio to thereby control a throttle actuator for actuating a throttle in accordance with the selected pattern. An intake air quantity detector detects a quantity of intake air fed to an engine of the motor vehicle. A comparator compares a target intake air quantity determined on the basis of the depression magnitude of the accelerator pedal and an actual intake air quantity. When the actual intake air quantity is substantially greater than the target one, a second controller reduces the engine output power by temporarily stopping the fuel supply to the engine or by temporarily halting operations of some engine cylinders.

8 Claims, 5 Drawing Sheets

CONTROL APPARATUS IN A MOTOR VEHICLE FOR CONTROLLING A THROTTLE VALVE ON THE BASE OF ACTUATION OF AN ACCELERATOR PEDAL AND INTAKE AIR QUANTITY

BACKGROUND OF THE INVENTION

1. Field of the Invention

The present invention relates generally to a control apparatus for a motor vehicle. More particularly, the invention is concerned with a control apparatus for electrically controlling a throttle vale of an internal combustion engine for a motor vehicle.

2. Description of the Related Art

In a conventional throttle valve control apparatus of an internal combustion engine (hereinafter also referred to simply as the engine) for an automobile or a motor vehicle, a throttle valve is mechanically linked to an accelerator pedal in such a manner that the opening degree of the throttle valve can controllably be changed in dependence on the magnitude or amount of depression of the accelerator pedal. More particularly the opening degree of the throttle valve is electrically controlled through a throttle actuator in dependence on amount of depression of an accelerator pedal and the speed of the motor vehicle, as is disclosed, for example, in Japanese Kokai No. 261635/1986 (JP-A-61-261635). The structure of this conventional throttle valve control apparatus is shown in functional block diagram FIG. 6.

Referring to FIG. 6, the conventional control apparatus is basically comprised of a vehicle speed sensor 2 for detecting the speed of a motor vehicle equipped with this control apparatus, a control means 5 for controlling a throttle actuator 6 on the basis of both an actual throttle opening signal representative of the actual opening degree of a throttle valve, and a target throttle opening signal representative of a target opening degree of the throttle valve inputted to the control means 5, as well as a vehicle speed signal, as described hereinafter, a throttle valve 7 whose opening degree is rotationally controlled by the throttle actuator 6 and a throttle opening sensor 8 for detecting the opening degree of the throttle valve 7.

Further, the throttle control apparatus is equipped with an accelerator pedal depression detecting means 21 for detecting the depression of an accelerator pedal (not shown) of the motor vehicle, a function generator 22 having inputs supplied, respectively, with an accelerator pedal depression signal $S_1$ from the accelerator pedal depression detecting means 21 and a throttle response signal (or acceleration response signal, stated another way). The function generator determines a relation between the depth of depression of the accelerator pedal and a target throttle valve opening on the basis of the acceleration response signal AG. The throttle control apparatus additionally comprises an average throttle valve opening calculating means 23 for arithmetically determining an average or mean value of the throttle valve 7 during a preceding predetermined period of running of the motor vehicle at predetermined intervals. Also provided are an average vehicle speed calculating means for arithmetically determining a means vehicle speed over a predetermined time at predetermined intervals, and an acceleration response calculating means for arithmetically determining an acceleration response or throttle response indicative of the sensitivity or response of the throttle valve 7 to the actuation or depression of the accelerator pedal on the basis of the average vehicle speed signal and the average throttle opening signal. The throttle actuator 6 is so controlled by the control means 5 that the opening degree of the throttle valve 7 becomes equal to the target or command value. For more particulars of the individual components of this known control apparatus, reference should be made to the publication mentioned hereinbefore.

In operation of the throttle opening control apparatus of the structure described above, the depression of the accelerator pedal actuated by the driver is detected by the accelerator pedal depression detecting means 21, whereby the opening of the throttle valve 7 is controlled in dependence on the accelerator pedal depression in accordance with a given functional relationship. To this end, the function generator 22 generates a functional relation between the accelerator pedal depression and the throttle opening on the basis of the acceleration response signal outputted from the unit 25, to thereby issue a target throttle opening command signed to control means 5. The acceleration response signal represents the relation between the average or mean vehicle speed and the mean throttle valve opening control means 5 then responds by controlling the throttle opening through the throttle actuator 6 which may be constituted by a stepping motor, a DC motor or the like and a gear train.

In this conjunction, for a given opening degree of the throttle valve, the vehicle speed will vary in dependence on changes in the load imposed on the motor vehicle. This experienced when the vehicle is driven to run on a road abounding with uphills and downhills. To compensate for such variations in the load on the control of the throttle opening, the mean throttle opening as well as the mean vehicle speed successively determined for a predetermined period at predetermined intervals are adopted as correcting parameters. For example, the function generator 22 generates a function which acts as follows. Namely, if the mean vehicle speed is low for a predetermined period notwithstanding of a large value of the mean throttle opening, it is determined that the vehicle is subject to a large load, that is the vehicle is travelling on an uphill. In this case, the function generated for throttle control is such that it increased the throttle opening to a value greater than a normal value which is obtained during a normal running state of the vehicle in which the vehicle travels on a level road. On the other hand, if the mean value is high for the predetermined period in spite of a small value of the mean throttle opening, it is determined that the load on the vehicle is small, that is the vehicle is travelling on a downhill. In this case, the function generated is such that it decreased the throttle opening to a value smaller than the normal value.

As is apparent from the foregoing, with the above-mentioned conventional throttle valve control apparatus, the throttle opening control is conducted by detecting not only the pedal depression depth which represents a target vehicle speed commanded by the driver but also the actual vehicle speed which is subjected to variations in dependence on the running state or load condition of the motor vehicle to thereby control the throttle opening so that it reflects the target vehicle speed, in an endeavor to enhance the drivability or maneuverability of the motor vehicle.

However, with such control, information about the gear ratio or gear position of the motor vehicle is not employed or reflected, so it is difficult to realize an enhanced accelerating ability as well as maneuverability intrinsically required for the motor vehicle. In fact, even with the same vehicle speed and the same throttle opening, acceleration performance of the vehicle significantly varies in dependence upon the gear ratio or gear position.

Besides, in the above-mentioned conventional control apparatus, no reasonable consideration is paid to the possibility of occurrence of a failure in the throttle valve control apparatus and more particularly a failure in the throttle actuator 6, the throttle opening sensor 8 or the like. Thus, if the throttle actuator 6 fails with the throttle valve being held open, or if the throttle opening sensor 8 fails while continuously generating an output signal indicative of an open position of the throttle valve 7, the vehicle will cause a runaway.

Accordingly, there exists a demand for solving the above problems from which the conventional throttle control apparatus for the motor vehicle suffers.

SUMMARY OF THE INVENTION

In the light of the state of the art discussed above, it is an object of the present invention to provide a control apparatus for a motor vehicle which is capable of enhancing the maneuverability or accelerating ability of the motor vehicle under any operating condition thereof by taking account of information about the gear ratio or gear position of the vehicle in addition to the vehicle speed and the amount of depression of an accelerator pedal by the driver.

It is another object of the present invention to provide a control apparatus for a motor vehicle with a fail-safe function which can positively suppress the possibility of an uncontrollable running or runaway of the motor vehicle in the event of occurrence of a failure in a throttle control system including a throttle actuator, a throttle opening sensor or the like.

In view of the above and other objects which will become apparent as description proceeds, there is provided according to a first aspect of the present invention a control apparatus for a motor vehicle which comprises an accelerator pedal actuation detecting means for detecting a magnitude of actuation of an accelerator pedal of the motor vehicle and generating a corresponding output signal; vehicle speed detecting means for detecting a running speed of the motor vehicle and generating a corresponding output signal; gear ratio detecting means for detecting a gear ratio of a transmission of the motor vehicle and generating a corresponding output signal; a throttle actuator for moving a throttle valve in an intake manifold of the motor vehicle; and a signal processing unit responsive to the output signals from the accelerator pedal actuation detecting means, the vehicle speed detecting means and the gear ratio detecting means for controlling the throttle actuator. The signal processing unit includes storage means for storing a plurality of target throttle opening patterns representing relations between target values of throttle opening degree and magnitudes of actuation of the accelerator pedal; and control means for selectively determining an optimum target throttle opening control pattern on the basis of the vehicle speed and the gear ratio, to thereby control the throttle actuator for actuating the throttle valve in accordance with the selected control pattern based on the magnitude of actuation of the accelerator pedal.

Further, according to a second aspect of the present invention, there is provided a control apparatus for a motor vehicle which comprises: intake air quantity detecting means for detecting a quantity of intake air fed to an internal combustion engine of the motor vehicle and generating a corresponding output signal; accelerator pedal actuation detecting means for detecting a magnitude of actuation of an accelerator pedal of the motor vehicle and generating a corresponding output signal; a throttle actuator for moving a throttle valve in an intake manifold of the motor vehicle; and a signal processing unit responsive to the output signals from the intake air quantity detecting means and the accelerator pedal actuation detecting means for controlling the throttle actuator based on the quantity of intake air and the magnitude of actuation of the accelerator pedal, the signal processing unit being operable to determine a target air quantity on the basis of the magnitude of actuation of the accelerator pedal. The signal processing unit includes comparison means for comparing the target intake air quantity with an actual intake air quantity as detected by the intake air quantity detecting means; and control means for reducing the output power of the internal combustion engine when the actual intake air quantity is substantially greater than the target intake air quantity.

According to a third aspect of the invention, there is provided a control apparatus for a motor vehicle which comprises: engine load detecting means for detecting a pressure in an intake manifold of an internal combustion engine of the motor vehicle and generating a corresponding output signal; accelerator pedal actuation detecting means for detecting a magnitude of actuation of an accelerator pedal of the motor vehicle and generating a corresponding output signal; a throttle actuator for moving a throttle valve in the intake manifold; and a signal processing unit responsive to the output signals from the engine load detecting means and the accelerator pedal actuation detecting means for controlling the throttle actuator based on the pressure in the intake manifold and the magnitude of actuation of the accelerator pedal, the signal processing unit being operable to determine a target intake manifold pressure on the basis of the magnitude of actuation of the accelerator pedal. The signal processing unit includes: comparison means for comparing the target intake manifold pressure with an actual intake manifold pressure as detected by the engine load detecting means; and control means for reducing the output power of the internal combustion engine when the actual intake manifold pressure is substantially greater than the target intake manifold pressure.

With the structure of the control apparatus provided according to the first aspect of the invention, output torque of the engine generated upon acceleration of the motor vehicle can smoothly be increased not withstanding of variations in the running state or load of the motor vehicle by virtue of the feature that the target throttle opening for a given magnitude of actuation or depression of the accelerator pedal is controlled in accordance with the most appropriate pattern that is selected from the plurality of target throttle opening control patterns on the basis of the vehicle speed and the gear ratio.

On the other hand, with the control apparatus according to the second or third aspect of the invention, it is possible to prevent the runaway of the motor vehicle by reducing the engine output power through an appropriate measure such as interruption of the fuel supply to the engine, interruption of combustions in some of engine cylinders even if a failure occurs in the throttle actuator, the throttle opening sensor and other components taking parts in the throttle valve control in the state where the throttle valve is opened, by incorporating the function of comparing the target intake air quantity with the actual intake air quantity, or the function of comparing the target intake manifold pressure with the actual intake manifold pressure.

The above and other objects, features and attendant advantages of the present invention will become more apparent upon reading the following description of the preferred or exemplary embodiments thereof taken in conjunction with the drawings.

DESCRIPTION OF THE PREFERRED EMBODIMENTS

Now, the present invention will be described in detail in conjunction with preferred or exemplary embodiments thereof by reference to the drawings.

Figure 1:
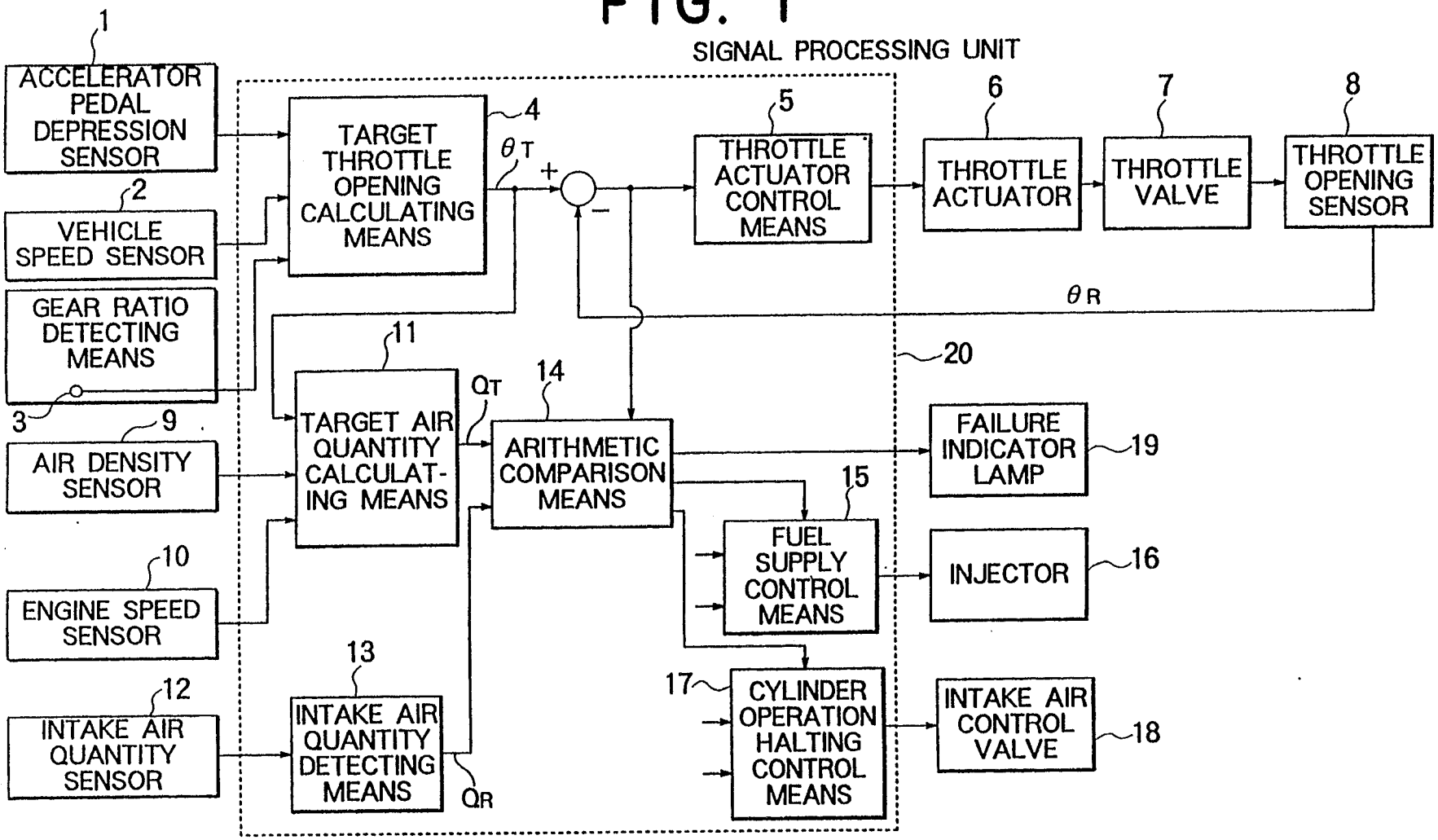
FIG. 1 is a functional block diagram showing an arrangement of a control apparatus for a motor vehicle according an embodiment of the present invention.

FIG. 1 shows in a functional block diagram the arrangement of a control apparatus for a motor vehicle according to a first embodiment of the present invention. Referring to the figure, a signal processing unit 20 includes a target or desired throttle opening calculating means 4 which is supplied with various signals such as an output signal from an accelerator pedal depression sensor 1 which detects the depth of depression (magnitude of actuation) of an accelerator pedal of a motor vehicle (not shown) operated by the driver, an output signal from a vehicle speed sensor 2 which detects the running speed of the vehicle, and an output signal from a gear ratio detecting means 3 which detects a gear position of a transmission (also not shown). Based on the various input signals mentioned above, the target throttle opening calculating means 4 calculates or arithmetically determines a target or desired opening degree $\theta_T$ of a throttle valve 7.

Figure 2:
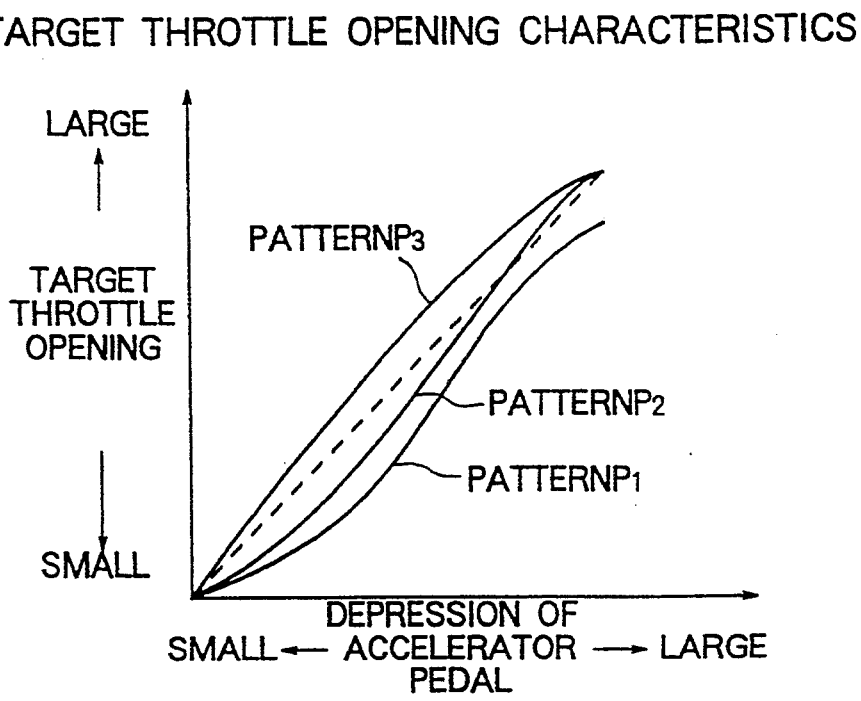
FIG. 2 is a view illustrating graphically patterns which represent characteristically relations between target throttle opening degrees and accelerator pedal depression depths.

In this conjunction, the target throttle opening degree is determined in accordance with a function which defines a relation between the target throttle opening and the depth of depression of the accelerator pedal. To this end, relations are previously established between the target throttle openings and the accelerator pedal depressions, as illustrated in FIG. 2. More specifically, in FIG. 2., a curve or pattern $P_1$ of a gentle slope represents the above-mentioned relation when the magnitude of depression of the accelerator pedal is small; a pattern $P_2$ represents the relation when the magnitude of depression of the accelerator pedal is intermediate; and a pattern or curve $P_1$ having a steep slop represents the relation when the accelerator pedal is depressed most deeply. In the control of the opening degree of the throttle valve, one of these patterns $P_1$, $P_2$, and $P_1$ is selected for determining the target or desired throttle opening in dependence on the running condition of the motor vehicle.

Figure 3:
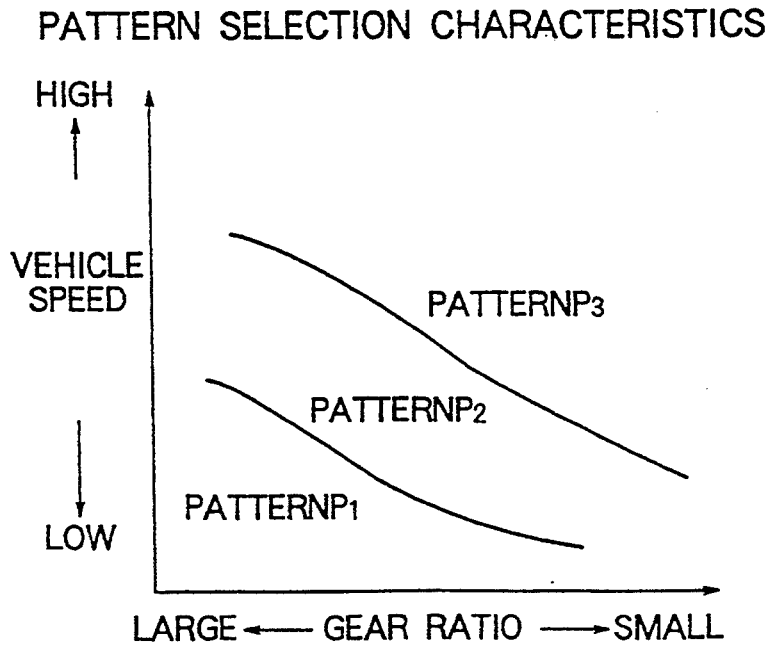
FIG. 3 is a view showing graphically those regions determined by vehicle speeds and change gear ratios of transmission in which the patterns shown in FIG. 2 can be adopted, respectively.

The selection of an appropriate pattern $P_1$, $P_2$ or $P_3$ is made on the basis of the gear ration and the vehicle speed, as is illustrated in FIG. 3. Referring to this figure, it is assumed, by way of example, that the motor vehicle is accelerating in a region where the gear ratio is high or large with the vehicle speed being low. Then, the engine will generate a large output torque, exerting a shock to the driver. Accordingly, in this region, an optimum pattern or function $P_1$ is selected for lowering the response of the throttle valve to the accelerator pedal depression (i.e., the ratio of a target throttle opening to a given depression amount of the accelerator pedal), to thereby avoid or mitigating the possible shock.

In contrast, in the region where the gear ratio is low or small and the vehicle speed is high with the throttle opening being small, an acceleration of the motor vehicle will not bring about any appreciable shock. Accordingly, in this region, an optimum pattern or function $P_3$ can be selected for improving the acceleration performance of the motor vehicle by increasing the response or ratio of a target throttle opening to a given actuation depth of the accelerator pedal.

The selection of an optimum pattern and the determination of a target throttle opening in accordance with the selected pattern are executed by the target throttle opening calculating means 4 to thereby provide a target throttle opening signal $\theta_T$ in which the running and load condition of the motor vehicle is taken into account.

Referring again to FIG. 1, a difference between an actual throttle opening $\theta_R$ indicated by the signal supplied from the throttle opening sensor 8 and the target throttle opening $\theta_T$ indicated by the signal supplied from the target throttle opening calculating means 4 is then determined in a manner as shown in the figure. On the basis of this difference, a throttle actuator control means 5 electrically controls the throttle actuator 6 via a PID (position, integral and differential) control loop known in the art, to thereby move the throttle valve 7 to a position corresponding to the target or desired throttle opening degree.

Figure 4:
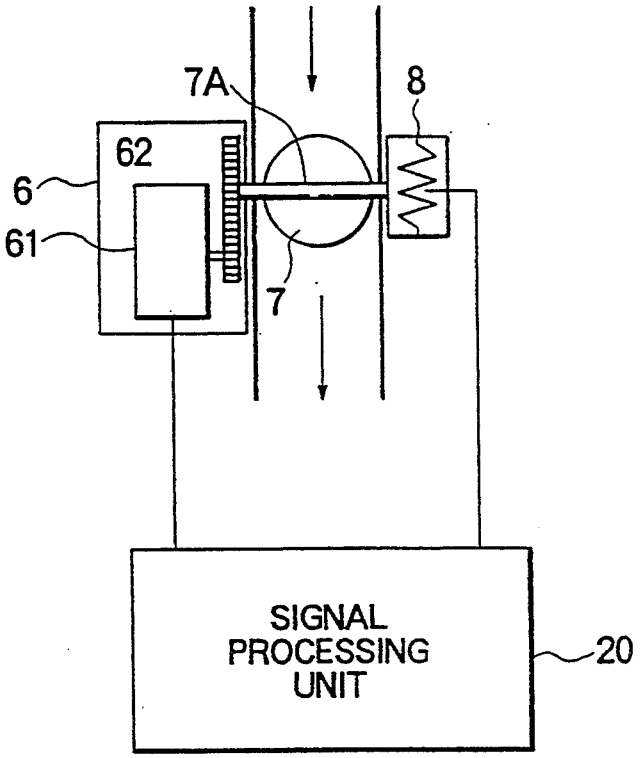
FIG. 4 is a view showing schematically a structure of a throttle actuator.

The throttle actuator 6, the throttle valve 7 and the throttle opening sensor 8 are assembled and installed in such a manner as shown in FIG. 4. Referring to the figure, an electric motor 61 such as a step motor, a DC motor and the like, which constitutes a part of the throttle valve actuator 6, is driven in response to an electric control signal outputted from the throttle actuator control means 5 of the signal processing unit 20, wherein the output of the motor 61 is transmitted to a gear train 62 to thereby rotate a shaft 7A on which the throttle valve 7 is mounted, whereby the throttle opening is correspondingly changed. At that time, the throttle opening sensor 8, which is mechanically coupled to the shaft 7A, detects the angular position of the shaft 7A and generates a corresponding output signal $\theta_R$ indicative of an actual throttle opening which is fed back to the input of the throttle actuator control means 5 for the PID control mentioned above.

Description will now be directed to a fail-safe system. Referring to FIG. 1, an air density sensor 9 detects an air density $\rho$ on the basis of the atmospheric pressure and the temperature of the intake air drawn into the engine. An engine speed sensor 10 detects the engine rotation speed (rpm) and outputs a corresponding engine rotation speed signal Ne. The output signals $\rho$ and Ne from the sensors 9 and 10 are supplied to a target intake air quantity calculating means 11 together with the target throttle opening signal $\theta_T$ delivered from the target throttle opening calculating means 4. On the basis of these signals $\rho$, Ne and $\theta_T$, the target intake air quantity calculating means 11 determines a target intake air quantity $Q_T$ in accordance with the following expression:

$$Q_T = f(\theta_T, Ne) \times g(\rho) \quad (1)$$

The signal processing unit 20 further includes an intake air flow detecting means 13 which cooperates with an air flow sensor 12 to determine an actual air flow or actual intake air quantity $Q_R$ through a procedure which is known per se. The target intake air quantity signal $Q_T$ and the actual intake air quantity signal $Q_R$ are inputted to an arithmetic comparison means 14 which performs a comparison between the target intake air quantity $Q_T$ and the actual intake air quantity $Q_R$ in the currently prevailing engine operation state which is indicated by the difference signal derived from the aforementioned target throttle opening signal supplied to the throttle control train or throttle opening signal supplied to the throttle control train or throttle control system (5, 6, 7, 8). When the result of this comparison indicates the occurrence of an abnormality in the throttle control train (5, 6, 7, 8), the arithmetic comparison means 14 generates a signal for lighting a failure indicator lamp 19. Further, when there is a possibility of an occurrence of an abnormality the comparison means 14 issues a signal which commands a fuel supply control means 15 to interrupt or cut off the fuel supply to all the engine cylinders or a half of them in dependence on the level of the abnormality by correspondingly controlling a fuel injection system 16.

The signal processing unit 20 further includes a cylinder operation halting means 17 for decreasing the engine output torque by controlling, as a high-priority control upon occurrence of the unwanted situation mentioned above, intake air control valves 18, which are disposed in an intake manifold for controlling the intake air supplied to the respective cylinders.

Figure 5:
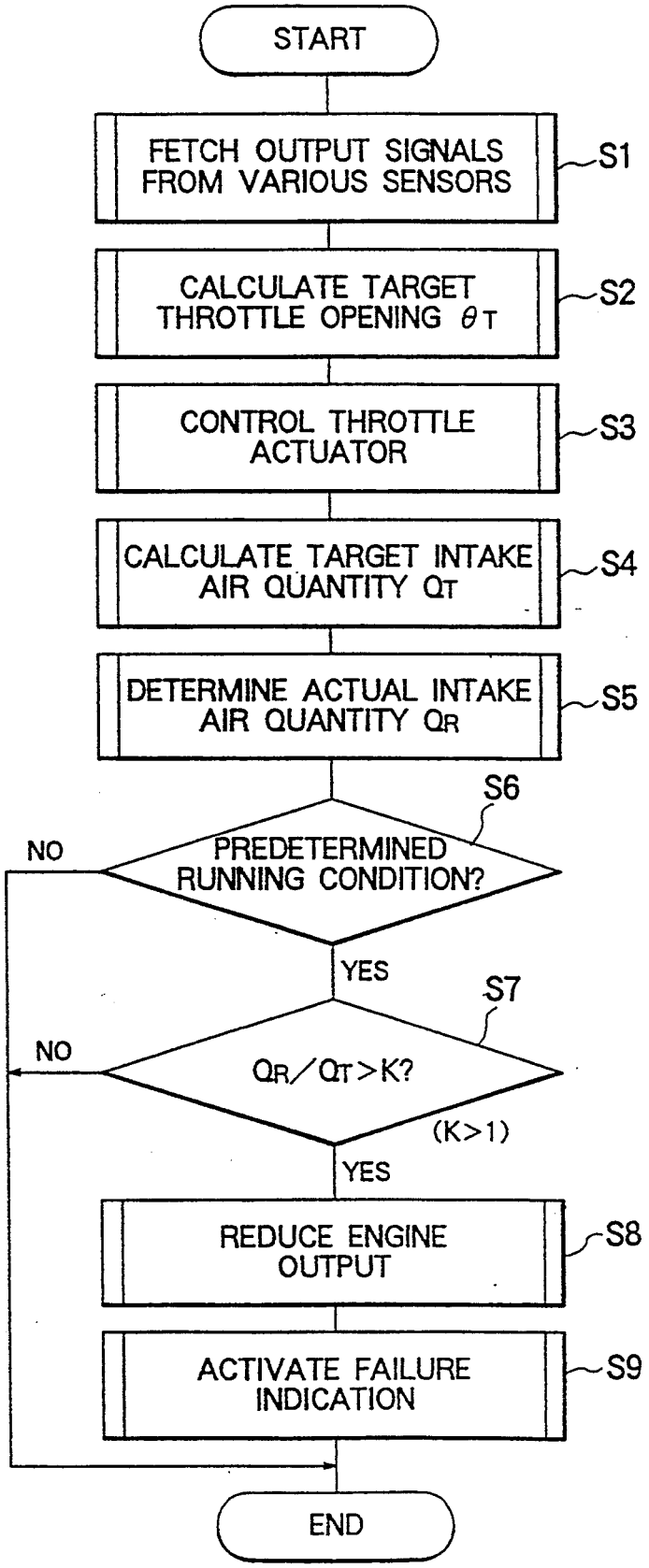
FIG. 5 is a flow chart for illustrating operation of a signal processing unit in the control apparatus shown in FIG. 1.
Figure 6:
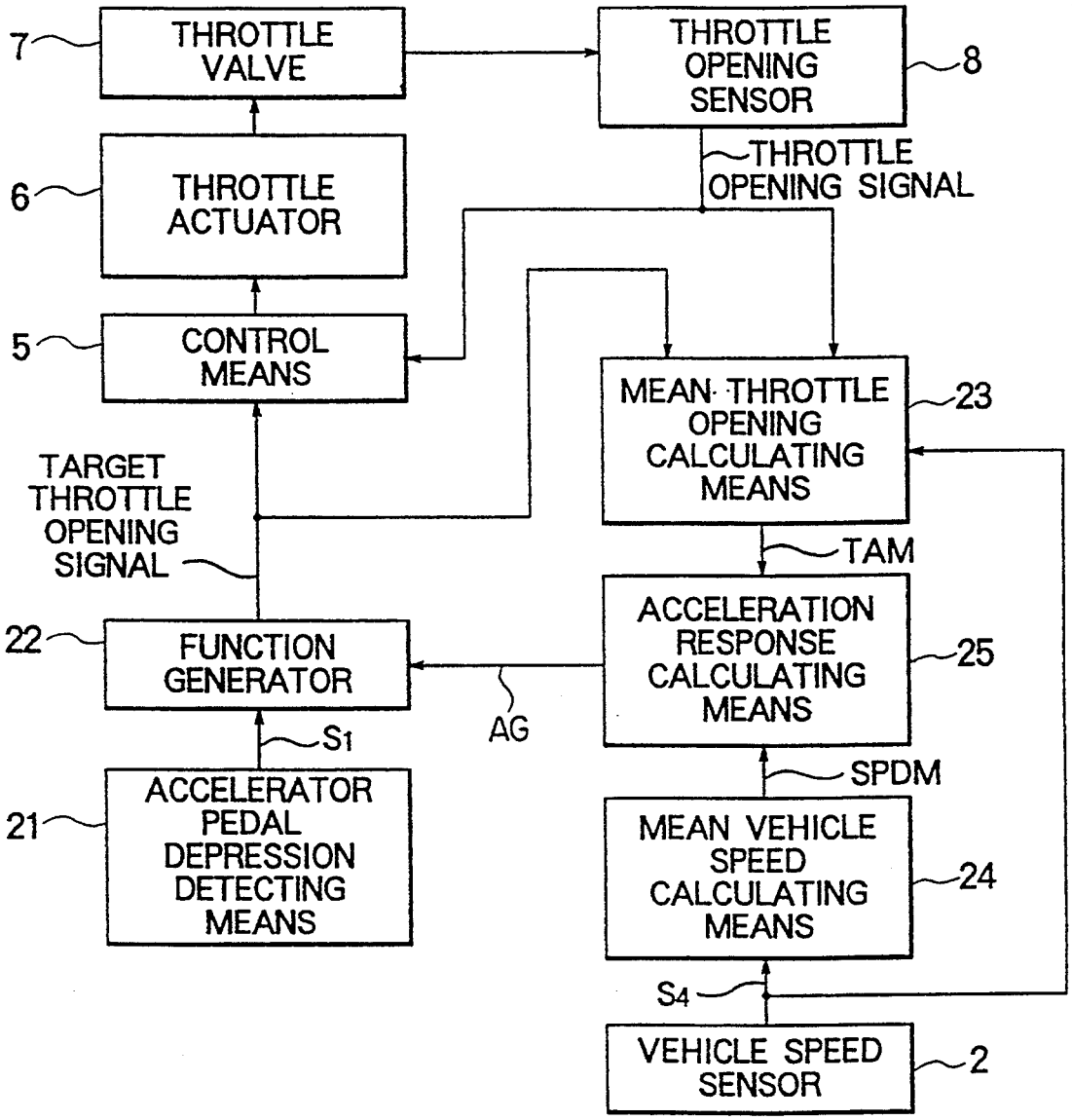
PRIOR ART FIG. 6
FIG. 6 is a functional block diagram showing a structure of an engine control apparatus known heretofore.

Next, the operation of the signal processing unit 20 will be elucidated by reference to a flow chart shown in FIG. 5 with emphasis being placed on the operation of the arithmetic comparison means 14.

Referring to FIG. 5, in a step S1, the information signals available from the outputs of the various sensors mentioned above are fetched. In a step S2, the target throttle opening degree $\theta_T$ is arithmetically determined by the target throttle opening calculating means 4 through the procedure described hereinbefore. In a succeeding step S3, the throttle actuator 6 is controlled by the throttle actuator control means 5 on the basis of the target throttle opening degree $\theta_T$ as determined above and the actual throttle opening degree $\theta_R$ such that the difference between these signals $\theta_T$ and $\theta_R$ becomes at least substantially zero. Subsequently, in a step S4, the target intake air quantity $Q_T$ is arithmetically determined or calculated, while in a succeeding step S5, the actual intake air quantity $Q_R$ is determined. Thereafter, in precedence to the comparison between the target intake air quantity $Q_T$ and the actual intake air quantity $Q_R$, it is determined in a step S6 whether or not the motor vehicle is in a predetermined operation state. In this conjunction, it should be understood that the actual intake air quantity $Q_R$ becomes substantially equal to the target intake air quantity $Q_T$ only when the throttle control train (5, 6, 7, 8) operates in the normal condition and when the engine operates in a steady state. This decision may be made on the basis of the actual throttle opening and the target throttle opening. As the prerequisites for the above-mentioned condition to be satisfied, the following conditions are requried:

1) The engine is in a predetermined operating region (which is determined on the basis of the engine rotational speed ne and the actual intake air quantity $Q_R$).

2) Neither abrupt acceleration nor deceleration of the motor vehicle is performed (i.e., the variation in the difference between the target throttle opening degree $\theta_T$ and the actual throttle opening degree $\theta_R$ as a function of time remains small).

3) Conditions 1) and 2) above are maintained for a predetermined time.

4) The engine is not in an engine starting period.

5) The engine is not in a standstill.

When it is determined in the step S6 that all the conditions 1) through 5) mentioned above are met, the processing proceeds to a step S7 where the target intake air quantity $Q_T$ and the actual intake air quantity $Q_R$ are compared with each other. When the comparison in the step S7 results in that the ratio $Q_R/Q_T$ is greater than K (where $K>1$), this means that the actual intake air quantity $Q_R$ is greater than the target intake air quantity $Q_T$ commanded by the driver, indicating a possible runaway of the motor vehicle. As a major cause of such a possibility, there may be mentioned the locking of the motor 61 of the throttle actuator 6 with the throttle valve 7 being held open (i.e., the throttle valve 7 is locked in an open state). In that case, the motor vehicle may continue to run uncontrollably even when the accelerator pedal is released. Accordingly, it becomes necessary to decrease or lower the engine output powder by resorting to other measures than the release of the accelerator pedal.

It is further noted that upon occurrence of an abnormality in the operation of the throttle opening sensor 8 (e.g., when the opening degree of the throttle valve 7 detected by the throttle opening sensor 8 is smaller than the actual opening degree thereof), the throttle valve 7 is further opened undesirably through the feedback control mentioned hereinbefore in contradiction to the command of the driver. In practical applications, however, it is to be noted that although a failure in the throttle actuator 6 such as the locking of the motor 61 or the gear train 62 can be detected by comparing the target intake air quantity $Q_T$ with the actual intake air quantity $Q_R$, it is impossible to positively detect the occurrence of an abnormality in the throttle opening sensor 8 by virtue of such a comparison.

If the condition "$Q_R/Q_T>K$" (where K is an integer greater than 1) applies valid in the step S7 (i.e., the actual intake air quantity $Q_R$ is substantially greater than the target intake air quantity $Q_T$), an engine output decreasing processing is performed in a step S8. To this end, a s a first method, the fuel supply to the engine can be stopped. As a second method, in the case of an engine equipped with a cylinder operation halting control system in which combustions in some of cylinder are forced to halt as desired from improving combustion efficiency in the remaining cylinders particularly in a low load operation of the engine, a cylinder operation halting control can be effected by the cylinder operation halting control means 17 to halt combustions in some cylinders, for example, by closing some of intake air control valves 18 to stop the supply of intake air to the corresponding cylinders. Subsequently, in a step S9, a failure code is set to thereby generate a failure indication.

In the forgoing description of the embodiment of the invention, if the condition "$Q_R/Q_T>K$" (where $K>1$) is met, it is determined that a failure takes place in the throttle actuator operating system with the throttle valve being held open. It goes, however, without saying that if the condition "$Q_T/Q_R>K$" (where $K>1$) applies valid, a determination can similarly be made that a failure occurs n the throttle operating system with the throttle valve being held in the closed state. Further, it should be appreciated that the processing for clearing the fault code is omitted from the illustration of FIG. 5.

It should further be understood that in place of setting a single failure code indicative of the occurrence of a failure in the throttle control system as a whole, one failure indication can be generated for the throttle actuator 6 inclusive of the motor 61 and the gear train 62, and another failure indication can also be made for the throttle opening sensor 8 separately from the throttle actuator 6. The ratio of $Q_R/Q_T$ is less than K ($K>1$) in the case of a failure of the throttle opening sensor 8 erroneously indicative of the closure or a small throttle opening of the throttle valve 7, similarly to the case in which the throttle actuator 6 is locked in the open state of the throttle valve 7. However, the actual throttle valve opening $\theta_R$ as sensed by the throttle opening sensor 8 is greater than the target throttle opening $\theta_T$ in the case of a failure of the throttle valve actuator motor being locked with the throttle valve 7 being held open, whereas the actual throttle valve opening $\theta_R$ is less than the target throttle valve opening $\theta_T$ under feedback control in the case of a failure en the throttle opening sensor 8 erroneously indicative of the closure or a limited opening degree of the throttle valve 7. Thus, the causes for such failures can discriminatively be identified.

In the following description, it has been assumed that a failure in the throttle control or operating system is detected through comparison between the target intake air quantity $Q_T$ and the actual air intake quantity $Q_R$. However, such a failure can equally be detected on the basis of a relation between a target engine load in the form of a target intake manifold pressure and an actual engine load in the form of an actual intake manifold pressure, with substantially the same effect. In this case, the engine operation can be controlled on the basis of the engine load in the form of the intake manifold pressure.

To this end, the arrangement of FIG. 1 can be modified as follows, the air flow sensor 12 is replaced by a pressure sensor which detects a pressure in the intake manifold and generates a corresponding output signal, and the intake air quantity detecting means 13 is replaced by an intake manifold pressure detecting means which receives the output signal from the pressure sensor and generates an output signal representative of an actual intake manifold pressure $P_r$ to the arithmetic comparison means 14. The pressure sensor and the intake manifold pressure detecting means together constitute an engine load detecting means. In addition, the target air quantity calculating means 11 is replaced by a target intake manifold pressure calculating means which receives the output signal representative of a target throttle opening $\theta_t$ from the target throttle opening calculating means 4 as well as the output signals from the air density sensor 9 and the rotational speed sensor 10 and calculates a target intake manifold pressure $P_t$ based on these signals, as in the case of the target air quantity calculating means 11. The arithmetic comparison means 14 receives the output signals $P_t$, $P_r$ from the target intake manifold pressure calculating means and the intake manifold pressure detecting means and compares a ratio of the target intake manifold pressure $P_t$ to the actual intake manifold pressure $P_r$ with a predetermined value K (where $K>1$). If the ratio $P_r/P_t$ is greater than K (i.e., the actual intake manifold pressure $P_r$ is substantially greater than the target intake manifold pressure $P_t$), the arithmetic comparison means 14 determines a failure of the throttle control system with the throttle valve 7 being held open, and then takes an appropriate measure for reducing the engine output power, as in the case of the FIG. 1 embodiment. That is, the fuel supply to the engine is temporarily stopped or a cylinder operation halting control as mentioned above is temporarily effected.

As is apparent from the foregoing, with the control apparatus according to the first aspect of the invention, the drivability or accelerating performance of the motor vehicle can be enhanced by previously preparing a plurality of patterns representing relations between magnitudes of the accelerator pedal depressions and the target throttle opening degrees and selecting an optimum pattern on the basis of the vehicle speed and the gear ratio.

Further, according to a second or a third aspect of the invention, when the actual intake air quantity $Q_r$ is substantially greater than the target air intake quantity $Q_t$ (i.e., $Q_r/Q_t>K$, where $K>1$) or when the actual intake manifold pressure $P_r$ is substantially greater than the target intake manifold pressure $P_t$ (i.e., $P_r/P_t>K$, where $K>1$) as a result of comparison of these quantities $Q_r$ and $Q_t$ or these pressures $P_r$ and $P_t$, the engine output power is reduced to prevent the motor vehicle from causing a runaway. Thus, the operation of the engine and hence of the motor vehicle can positively be failsafed.

Many features and advantages of the present invention are apparent form the detailed specification and thus it is intended by the appended claims to cover all such features and advantages of the system which fall within the true spirit and scope of the invention. Further, numerous modifications and changes will readily occur to those skilled in the art. By way of example, the signal processing unti 20 may be constituted by a micro-computer including a central processing unit which is programmed to execute the processings described in conjunction with FIG. 5, a memory for storing the pattern data illustrated in FIGS. 2 and 3 and interface units for various sensors and output devices. However, since such micro-computer technology falls within the skill of the perform having ordinary knowledge in the art, description thereof is omitted. Accordingly, it is not target to limit the invention to the exact construction and operation illustrated and described, being understood that all suitable modifications and equivalents may be resorted to, falling within the scope of the invention.

What is claimed is:

1. A control apparatus for a motor vehicle, comprising:

accelerator pedal actuation detecting means for detecting a magnitude of actuation of an accelerator pedal of said motor vehicle and generating a corresponding output signal;

vehicle speed detecting means for detecting a running speed of said motor vehicle and generating a corresponding output signal;

gear ratio detecting means for detecting a gear ratio of a transmission of said motor vehicle and generating a corresponding output signal;

a throttle actuator for moving a throttle valve in an intake manifold of the motor vehicle; and a signal processing unit responsive to the output signals from said accelerator pedal actuation detecting means, said vehicle speed detecting means and said gear ratio detecting means for controlling said throttle actuator based on the magnitude of actuation of said accelerator pedal, the vehicle speed and the gear ratio;

said signal processing unit including:

storage means for storing a plurality of target throttle opening patterns representing relations between target values of throttle opening degree and magnitudes of actuation of said accelerator pedal; and control means (a) for determining a target throttle opening pattern from the plurality of target throttle opening patterns on the basis of the vehicle speed and the gear ratio, (b) for determining a target throttle opening on the basis of the determined optimum target throttle opening pattern, and the magnitude of actuation of said accelerator pedal, and (c) for controlling said throttle actuator on the basis of the determined target throttle opening;

wherein said patterns are previously established in dependence on at least one of a load condition and a running condition of said motor vehicle.

2. A control apparatus for a motor vehicle, comprising:

intake air quantity detecting means for detecting a quantity of intake air fed to an internal combustion engine of said motor vehicle and generating a corresponding output signal;

accelerator pedal actuation detecting means for detecting a magnitude of actuation of an accelerator pedal of said motor vehicle and generating a corresponding output signal;

a throttle actuator for moving a throttle valve in an intake manifold of the motor vehicle; and a signal processing unit responsive to the output signals from said intake air quantity detecting means and said accelerator pedal actuation dectecting means for controlling said throttle actuator based on the quantity of intake air and the magnitude of actuation of said accelerator pedal, said signal processing unit being operable to determine a target intake air quantity on the basis of the magnitude of actuation of said accelerator pedal;

said signal processing unit including:

comparison means for comparing the target intake air quantity with an actual intake air quantity as detected by said intake air quantity detecting means; and control means for reducing the output power of said internal combustion engine when the actual intake air quantity is substantially greater than the target intake air quantity;

wherein the target air quantity is determined on the basis of an atmospheric air density, an engine rotational speed and a target throttle opening which corresponds to the magnitude of actuation of said accelerator pedal.

3. A control apparatus for a motor vehicle, comprising:

intake air quantity detecting means for detecting a quantity of intake air fed to an internal combustion engine of said motor vehicle and generating a corresponding output signal;

accelerator pedal actuation detecting means for detecting a magnitude of actuation of an accelerator pedal of said motor vehicle and generating a corresponding output signal;

a throttle actuator for moving a throttle valve in an intake manifold of the motor vehicle; and a signal processing unit responsive to the output signals from said intake air quantity detecting means and said accelerator pedal actuation detecting means for controlling said throttle actuator based on the quantity of intake air and the magnitude of actuation of said accelerator pedal, said signal processing unit being operable to determine a target intake air quantity on the basis of the magnitude of actuation of said accelerator pedal;

said signal processing unit including:

comparison means for comparing the target intake air quantity with an actual intake air quantity as detected by said intake air quantity detecting means; and control means for reducing the output power of said internal combustion engine when the actual intake air quantity is substantially greater than the target intake air quantity;

wherein said control means stops the fuel supply to said internal combustion engine when the actual intake air quantity is greater than the target intake air quantity.

4. A control apparatus for a motor vehicle, comprising:

intake air quantity detecting means for detecting a quantity of intake air fed to an internal combustion engine of said motor vehicle and generating a corresponding output signal;

accelerator pedal actuation detecting means for detecting a magnitude of actuation of an accelerator pedal of said motor vehicle and generating a corresponding output signal;

a throttle actuator for moving a throttle valve in an intake manifold of the motor vehicle; and a signal processing unit responsive to the output signals from said intake air quantity detecting means and said accelerator pedal actuation detecting means for controlling said throttle actuator based on the quantity of intake air and the magnitude of actuation of said accelerator pedal, said signal processing unit being operable to determine a target intake air quantity on the basis of the magnitude of actuation of said accelerator pedal;

said signal processing unit including:

comparison means for comparing the target intake air quantity with an actual intake air quantity as detected by said intake air quantity detecting means; and control means for reducing the output power of said internal combustion engine when the actual intake air quantity is substantially greater than the target intake air quantity;

wherein said internal combustion engine includes cylinder operation halting control mans for halting an operation of each of engine cylinders as desired, and said control means activates said cylinder operation halting control means to halt operations of some of said cylinders when the actual intake air quantity is greater than the target intake air quantity.

5. A control apparatus for a motor vehicle, comprising:

accelerator pedal actuation detecting means for detecting a magnitude of actuation of an accelerator pedal of said motor vehicle and generating a corresponding output signal;

vehicle speed detecting means for detecting a running speed of said motor vehicle and generating a corresponding output signal;

gear ratio detecting means for detecting a gear ratio of a transmission of said motor vehicle and generating a corresponding output signal;

a throttle actuator for moving a throttle valve in an intake manifold of an internal combustion engine of said vehicle;

storage means for storing a plurality of target throttle opening patterns representing relations between target values of throttle opening degree and magnitudes of actuation of said accelerator pedal;

first control means for selectively determine an optimum target throttle opening pattern on the basis of the vehicle speed and the gear ratio, to thereby control said throttle actuator for actuating said throttle valve in accordance with said selected pattern based on the magnitude of actuation of said accelerator pedal, said first control means being operable to determine a target intake air quantity on the basis of the magnitude of actuation of said accelerator pedal;

intake air quantity detecting means for detecting a quantity of intake air fed to said internal combustion engine;

comparison means for comparing the target intake air quantity and an actual intake air quantity as detected by said intake air quantity detecting means; and second control means for reducing the output power of said internal combustion engine when the actual intake air quantity is substantially greater than the target intake air quantity.

6. A control apparatus according to claim 5, wherein the target intake air quantity is determined on the basis of an atmospheric air density, an engine rotational speed and a target throttle opening which corresponds to the magnitude of actuation of said accelerator pedal.

7. A control apparatus according to claim 5, wherein said control means stops the fuel supply to said internal combustion engine when the actual intake air quantity is greater than the target intake air quantity.

8. A control apparatus according to claim 5, wherein said internal combustion engine includes cylinder operation halting control means for halting an operation of each of engine cylinders as desired, and said control means activates said cylinder operation halting control means to halt operations of some of said cylinders when the actual intake air quantity is greater than the target intake air quantity.

* * * * *